US007186152B2

(12) United States Patent
Chen

(10) Patent No.: US 7,186,152 B2
(45) Date of Patent: Mar. 6, 2007

(54) ELECTRICAL CONTACT USED IN AN ELECTRICAL SOCKET

(75) Inventor: Yu-Chen Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/174,694

(22) Filed: Jul. 5, 2005

(65) Prior Publication Data

US 2006/0094308 A1 May 4, 2006

(30) Foreign Application Priority Data

Oct. 29, 2004 (TW) ..... 93217324 U

(51) Int. Cl.
*H01R 13/40* (2006.01)

(52) U.S. Cl. ..... 439/733.1; 439/943

(58) Field of Classification Search ..... 439/342, 439/70, 733.1, 862, 943, 343
See application file for complete search history.

(56) References Cited

U.S. PATENT DOCUMENTS 6,328,587 B1 * 12/2001 Hsu ..... 439/342
6,471,535 B1 * 10/2002 Walkup et al. ..... 439/342
2005/0124189 A1 * 6/2005 Johnescu et al. ..... 439/86

* cited by examiner

*Primary Examiner*—Phuong Dinh
(74) *Attorney, Agent, or Firm*—Wei Te Chung

(57) ABSTRACT

An electrical contact (1) used in a socket includes a base portion (11), a solder portion (12) bending front a bottom edge of the base portion, a vertical head (13) and a spring ann (14) extending from a top edge of the base portion and a contact portion (15) formed at a topmost end of the spring arm. The head and the spring arm extending upwardly from two opposite sides of the top edge of the base portion. A relatively large spacing (16) is defined between the head and the spring arm. The spring arm includes a body section (140) connecting with the base portion and a stretching section (142) adjacent the contact portion. This configuration makes the contact be more easily manufactured, thereby manufacturing casts is reduced.

1 Claim, 4 Drawing Sheets

ELECTRICAL CONTACT USED IN AN ELECTRICAL SOCKET

BACKGROUND OF THE INVENTION

1. Field of the Invention

The present invention relates to electrical contacts, and more particularly to an electrical contact for an electrical socket which can be relatively easily manufactured.

2. Background of the Invention

Electrical contacts are widely used in electrical socket connector to electrically bridge two electrical interfaces such as an electrical substrate, e.g. a PCB and an integrated circuit (IC) package, e.g. a central processing unit (CPU).

Referring to FIGS. 3 and 4, a typical electrical contact 2 includes a main body 21, a solder tail 25, a resilient arm 22 extending from a middle of an upper edge of the main body 21, two elongate stripe-like beams 23 and an mating portion 24 formed at a free end of the resilient arm 22. However, as the two beams 23 are generally symmetrically located two sides of the resilient arm 22, clearance 26 between each beam 23 and the resilient arm 22 is relatively narrow. Such a kind contact may have a typical problem of manufacturing difficulty, and thus manufacturing costs thereof may be increased.

What is needed, thereby, is a new electrical contact that can be easily manufactured, and thereby to reduce manufacturing cost.

SUMMARY OF THE INVENTION

An electrical contact according to a preferred embodiment of the present invention may include a base portion, a solder portion bending from a bottom edge of the base portion, a head, spring arm extending from a top edge of the base portion and a contact portion formed at a topmost end of the spring arm. The head and the spring arm extending upwardly from two opposite ends of the top edge of the base portion. A relatively large spacing is defined between the head and the spring arm. The spring arm includes a body section connecting with the base portion and a stretching section adjacent the contact portion. This configuration makes the contact be more easily manufactured, and manufacturing costs is reduced.

DETAILED DESCRIPTION OF THE PREFERRED EMBODIMENT OF THE INVENTION

Figure 1:
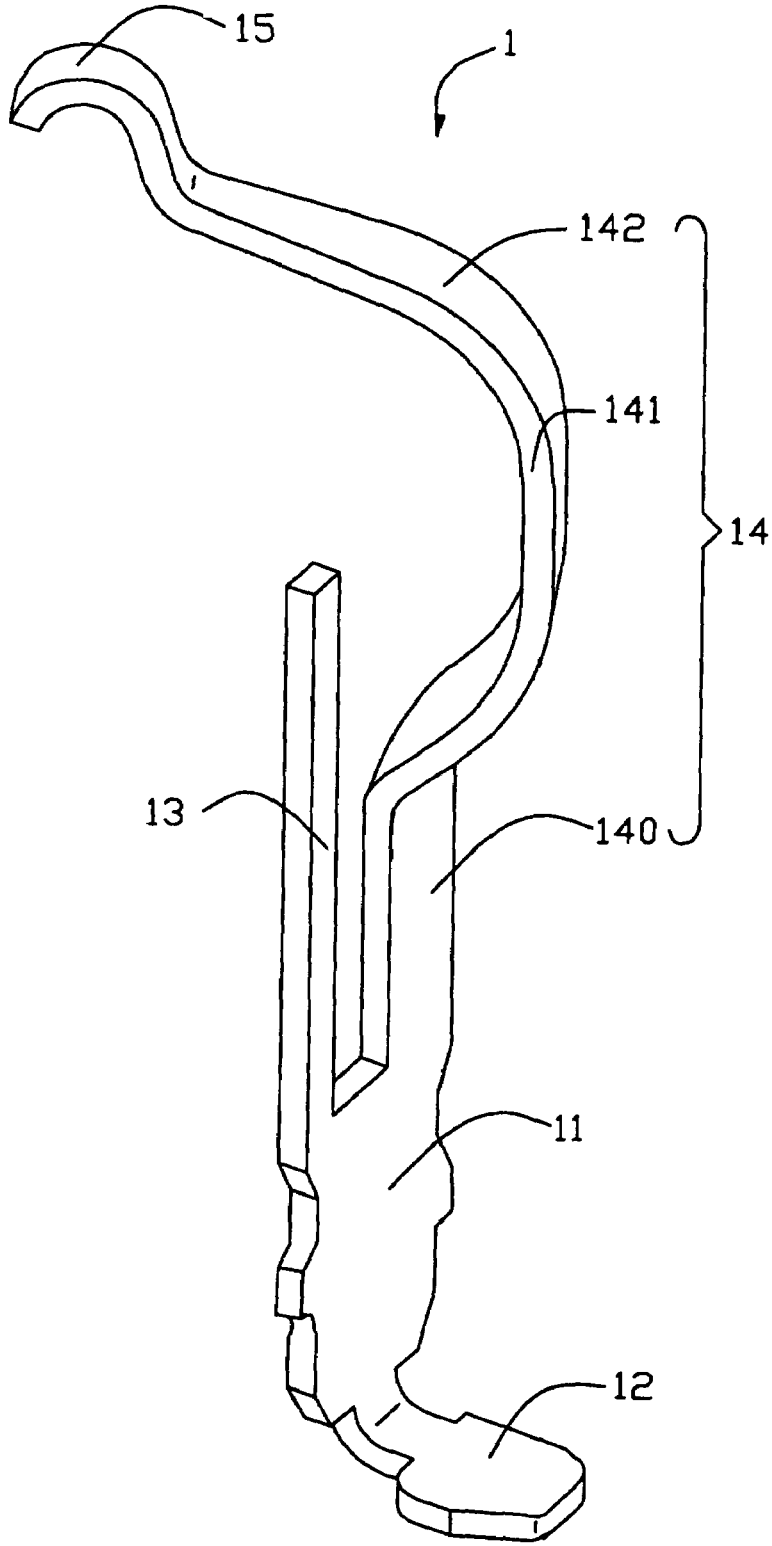
FIG. 1 is an isometric view of an electrical contact in accordance with a preferred embodiment of the present invention.

Referring to FIG. 1, an electrical contact 1 according to a preferred embodiment of the present invention is shown. The contact 1 is mainly used in an electrical socket, such as an LGA (Land Grid Array) socket (not shown), and adapted to electrically connect two interfaces, such as an IC package and a PCB (not shown), but not limited thereto.

Figure 2:
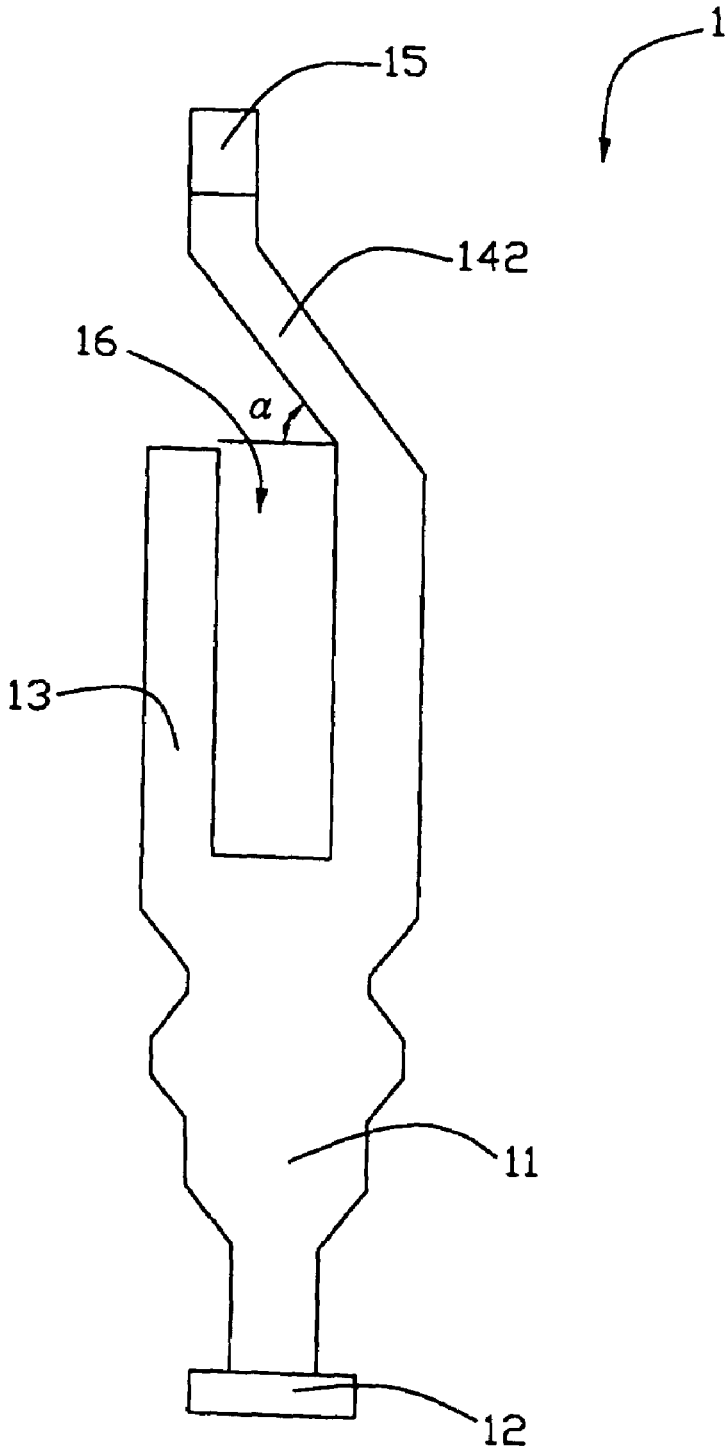
FIG. 2 is a front view of the contact of FIG. 1.

Referring also to FIG. 2, the contact 1 is formed from conductive material and has a vertical plate-like retention portion 11 with a generally symmetrical central line (not labeled). A plurality of barbs (not labeled) is formed on opposite lateral sides of the retention portion 11, for securing the contact 1 in a corresponding passage of the electrical socket.

For more reliable position of the contact 1 in the passage of the socket, an upright head portion 13 extends from a top end of the retention portion. In this preferred embodiment, the bead portion 13 is coplanar with the base portion 11 and has a generally elongate plate-like configuration. It should be understood that the head 13 may be figured to have other configurations, as long as it can be fit for fixing the contact 1 more reliably in the socket.

A horizontal tail 12 bends from a bottom edge of the retention portion 11. The tail 12 is substantially perpendicular to the retention portion 11 and has a relatively larger bottom surface (not numbered) vertical to the major surface of the retention portion 11. The tail 12 is used to establish electrical connecting between the contact and the PCB via a corresponding solder member, e.g. a solder ball (not shown).

A spring arm 14 extends upwardly from the top edge of the retention portion 11. The head portion 13 and the spring arm 14 are situated at two opposite sides of the central line of the retention portion 11, offsetting the central line a distance, respectively. A spacing 16 is defined between the spring arm 14 and the head 13.

With the configuration of the contact 1, the spring arm 14 extends in a curved or bend way and is devised to make good use of space, thereby the spring arm 14 can be relatively long and has a good elasticity. The arm 14 includes a body section 140 coplarnarly extending from the retention portion 1, a middle connecting section 141 bending from a top end of the body section 140 and a stretching section 142 interconnecting the middle section 141 and the contact portion 15. Particularly referring to FIG. 2, from a front view of the contact 1, an acute angle $\alpha$ is formed between the stretching section 142 and horizontal plane perpendicular to the body section 140. The angle $\alpha$ is preferably 45 degrees.

The contact 1 further has a contacting portion 15 formed at a distal end of the spring arm 14, being at a topmost part of the contact 1, for electrically engagingly mating with a corresponding conductive pad of the IC package. In this preferred embodiment, the contact portion 15 has an arced or curved configuration.

In use, the contact 1 is received in an insulative housing of the socket which serves to electrically connect the IC package and the PCB. The soldering portion 12 is electrically soldered to the PCB. The spring arm 14 produces resilient deformation by an exterior force acted on the contact 1. The contacting portion 15 urges and mates with a corresponding conductive pad of the IC package through elastic force generated by the resilient deformation of the spring arm 14. Thus, electrical connecting between the IC package and the PCB is established.

Figure 3:
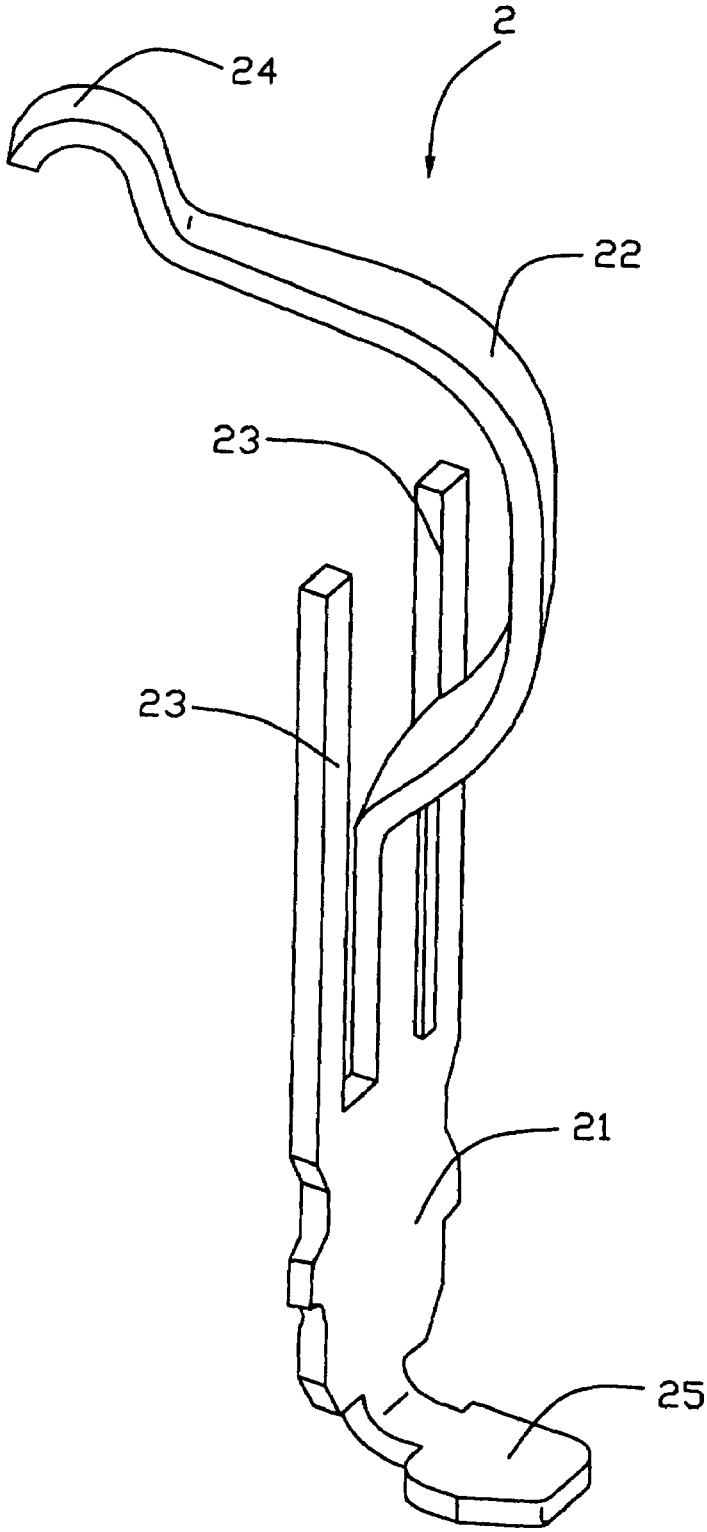
FIG. 3 (PRIOR ART)
FIG. 3 is an isometric view of a conventional electrical contact.
Figure 4:
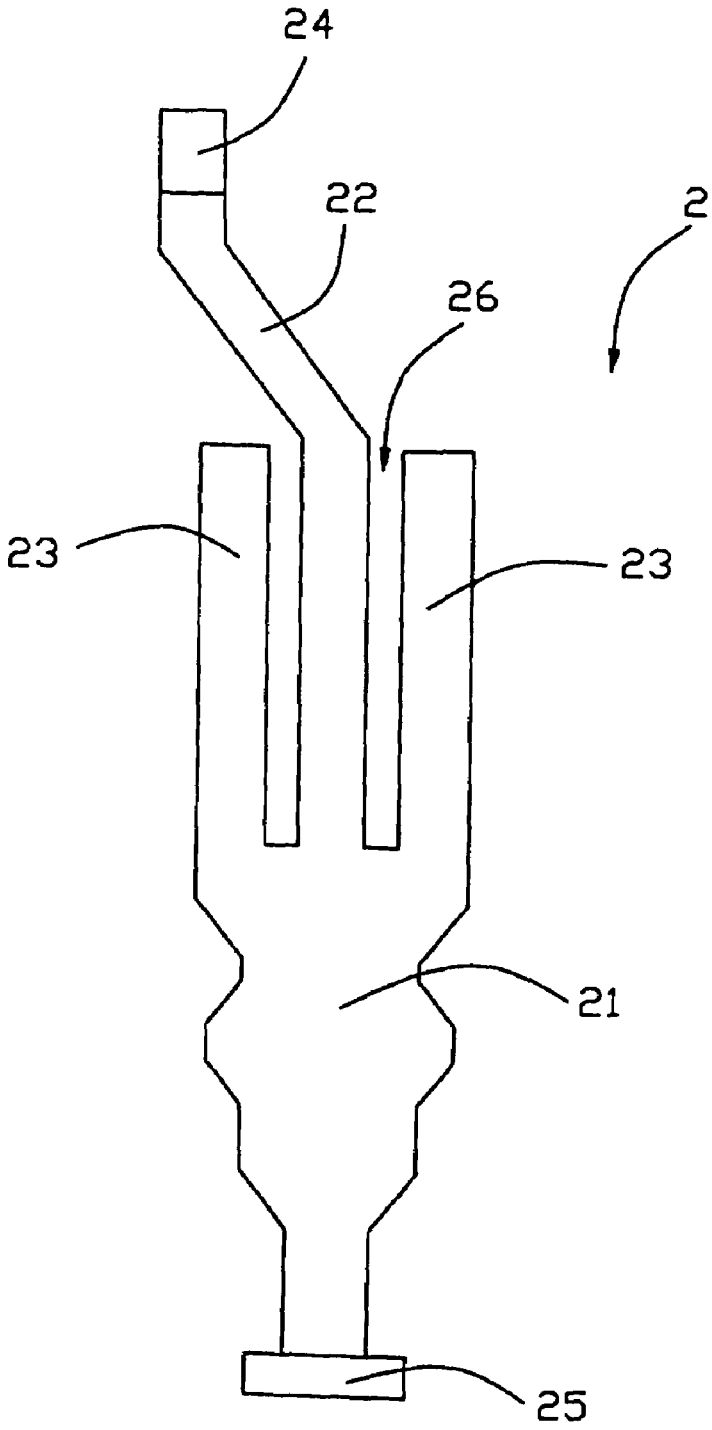
FIG. 4 (PRIOR ART)
FIG. 4 is a front view of the conventional contact of FIG. 3.

In the preferred embodiment, as the contact 1 just has one head portion 13, and the head portion 13 and the spring arm 14 are located two opposite end of the top edge of the base portion 11. Therefore, said spacing 16 between the head portion 13 and the spring arm 14 can be relatively larger or wider than said clearance 26 of the typical contact 2 in FIG. 3. As a result, the contact 1 can be more easily manufactured, compared to the typical contact 2, thereby the manufacturing costs can be reduced.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. An electrical contact comprising:

a base portion defining a plane extending therethrough, and including a mounting portion;

a spring arm extending from the top of the base portion, including a body section located coplanarly with the plane, a middle connecting portion extending from the body section and located at a first side of the plane, a stretching portion extending through and located the second side of the plane wherein the head portion is substantially coplanar with the base, wherein the spring arm comprises a body portion extending from the base portion and an upper winding portion connecting with the body portion, wherein the body portion of the spring arm is generally coplanar with the base portion, wherein the winding portion has a connecting section bending upwardly from a top end of the body portion and a stretching section extending from the connecting section, the stretching section connecting with the contacting portion, wherein from a front view the acute angle is defined between the stretching section and a horizontal piece perpendicular to the body portion; wherein the angle between the stretching section and a horizontal plane perpendicular to the body section is general 45 degrees; wherein the base portion forms a plurality barbs on opposite side thereof; wherein the tail portion is substantially perpendicularly to the base portion.

* * * * *